US005944438A

United States Patent [19]

Koyama et al.

[11] Patent Number: 5,944,438

[45] Date of Patent: Aug. 31, 1999

[54] WRITING INSTRUMENT

[75] Inventors: Takao Koyama, Tano-gun; Yoshiomi Konose, Sawa-gun, both of Japan

[73] Assignee: Mitsubishi Pencil Kabushiki Kaisha, Tokyo, Japan

[21] Appl. No.: 09/105,237

[22] Filed: Jun. 26, 1998

[30] Foreign Application Priority Data

Feb. 12, 1998 [JP] Japan ..... 10-029950

[51] Int. Cl.[6] ..... B43K 5/18

[52] U.S. Cl. ..... 401/227; 401/225

[58] Field of Search ..... 401/199, 198, 401/223, 224, 225, 227, 228, 229

[56] References Cited

U.S. PATENT DOCUMENTS 4,095,907 6/1978 Kuparinen ..... 401/225

4,207,012 6/1980 Kuparinen ..... 401/225

4,556,336 12/1985 Sano et al. ..... 401/225

4,712,937 12/1987 Schmidt et al. ..... 401/227

4,968,169 11/1990 Yokosuka et al. ..... 401/227

*Primary Examiner*—David J. Walczak

*Attorney, Agent, or Firm*—Darby & Darby

[57] ABSTRACT

A free ink type writing instrument using an ink containing an organic solvent as a main solvent, wherein a temporary ink reservoir member has a larger critical surface tension than a surface tension of the ink, and an absolute value of a difference between values of solubility parameters of a material constituting the temporary ink reservoir member and a solvent contained in the ink is 1 or more.

3 Claims, 3 Drawing Sheets

WRITING INSTRUMENT

BACKGROUND OF THE INVENTION

1. Field of the Invention

The present invention relates to a writing instrument, more specifically to a free ink type writing instrument in which an ink stored directly in an ink tank without absorbing a sliver or the like is fed to a pen tip from a temporary ink reservoir member.

2. Description of the Related Art

A member having a comb teeth-shaped cross section shown in FIG. 1 is known as a temporary ink reservoir member which is used as a flow controlling member of an ink in a free ink type writing instrument. Generally, such temporary ink reservoir member which has a much better wetting property to inks allows an ink to more easily flow between the comb teeth and therefore functions well as an ink reservoir.

Temporary ink reservoir members used for free ink type writing instruments which are commercially available in the market at present use ABS resins having good moldability, and it is proposed to add surfactants to inks containing water as a main solvent to control a surface tension of the inks or to subject temporary ink reservoir members to surface treatment such as plasma treatment and chromic acid mixture treatment to improve a wetting property to inks. However, satisfactory proposals to inks containing an organic solvent as a main solvent have not yet been made.

Organic solvents such as alcohols, glycols and glycol ethers tend to be used from a safety point of view in recent years. These organic solvents have a better wetting property to a temporary ink reservoir member than water because of their low surface tension, and in order to secure a satisfactory wetting property, a member having a larger critical surface tension is better used. In general, however, members having a large surface tension cause marked deformation and swelling with polar solvents such as alcohol and, in some cases they are dissolved therein and lose function as a temporary ink reservoir member.

Accordingly, it is considered to select materials having a relatively small critical surface tension to polar solvents such as alcohols for temporary ink reservoir members and to subject them to surface treatment including chromic acid mixture treatment and plasma treatment to thereby increase a critical surface tension on the surfaces of the members. However, not only the treatments themselves are complicated but also secondary steps for assuring the uniform treatment provided to the surfaces of the members are required.

Considering such situations, an object of the present invention is to provide a free ink type writing instrument in which an ink flows easily without subjecting a temporary ink reservoir member to specific surface modification and the member does not cause marked deformation and swelling with inks containing an organic solvent as a main solvent and in which temporary ink reservoir function works well.

SUMMARY OF THE INVENTION

Intensive researches repeated by the present inventors have resulted in finding that the object described above can be achieved by using a material having a large critical surface tension for a temporary ink reservoir member and employing a combination thereof with an ink containing an organic solvent as a main solvent, wherein an absolute value of a difference between solubility parameters of the temporary ink reservoir member and the solvent contained in the ink is 1 or more and the temporary ink reservoir member comprises preferably a crystalline polymer and wherein the ink has a smaller surface tension than a critical surface tension of the temporary ink reservoir member. The present invention has been completed based on this knowledge.

That is, the present invention provides a free ink type writing instrument using an ink containing an organic solvent as a main solvent, wherein a temporary ink reservoir member has a larger critical surface tension than a surface tension of the ink, and an absolute value of a difference between values of solubility parameters of a material constituting the temporary ink reservoir member and a solvent contained in the ink is 1 or more.

Materials constituting the temporary ink reservoir member used in the present invention are thermoplastic resins capable of being injection-molded and particularly preferably crystalline polymers. The main solvent contained in the ink used in the present invention is preferably an organic solvent such as alcohols, glycols and glycol ethers, and the ink has preferably a surface tension of 20 dyn/cm or more.

The direct flow writing instrument composed of a combination of the temporary ink reservoir member satisfying the requisites of the present invention and the ink containing an organic solvent as a main solvent has a good flow property of the ink together with high dimensional stability of the temporary ink reservoir member without subjecting the temporary ink reservoir member to specific surface modification and can exhibit excellent function as a flow-controlling member of an ink.

DESCRIPTION OF THE PREFERRED EMBODIMENT

Figure 1:
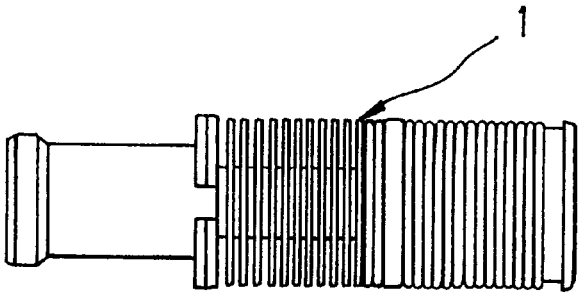
FIG. 1 is a plan showing one example of a crosssectional comb teeth-shaped ink reservoir member of a free ink type writing instrument.

The embodiments of the present invention shall be explained below in detail.

The material constituting the temporary ink reservoir member used in the present invention includes at least one of polypropylene (PP), polyacetal (POM and the like), polyethylene (PE), polyethers (modified polyphenylene ether), polyethylene terephthalate (PET), polybutylene terephthalate (PBT), polyamides (PA), polyether ether ketones (PEEK), acrylonitrile-styrene copolymers (AS) and polyamideimides (PAI), which are conventionally used as thermoplastic resins capable of being injection-molded, or a mixture of two or more kinds thereof.

The crystalline polymer particularly preferred in the present invention includes PP, POM, PET and PBT.

The solvent for the ink used in the present invention includes solvents which are conventionally used as solvents for inks for writing instruments, for example, at least one selected from monohydric alcohol base organic solvents, dihydric or polyhydric alcohol base organic solvents, ether base organic solvents, ketone base organic solvents, fatty acid base organic solvents, ester base organic solvents, hydrocarbon base organic solvents and glycol ether base organic solvents, or a mixture of two or more kinds thereof. The specific solvents which are particularly preferred in the present invention include ethanol, propylene glycol monomethyl ether (PGM), benzyl alcohol, ethylene glycol, ethylene glycol monomethyl ether and ethylene glycol monophenyl ether.

The temporary ink reservoir member in the present invention has to be such that an absolute value of a difference between values of solubility parameters of the temporary ink reservoir member and the solvent contained in the ink is 1 or more and comprises preferably a crystalline polymer. If the absolute value of a difference between values of solubility parameters of the material constituting the temporary ink reservoir member and the solvent contained in the ink is less than 1, the member increases in the affinity to the solvent and troubles such as dissolution, swelling and deformation are caused, so that the function as a temporary ink reservoir member is lost. Further, if the material is a non-crystalline polymer, the bonding power between the molecules is weak, and the solvent easily penetrates between the molecules, so that cracks, deformation and swelling are more easily brought about, and the function as an ink flow-controlling member is liable to be lost in a shorter time.

Further, in the present invention, the temporary ink reservoir member has to have a larger critical surface tension than a surface tension of the ink. In this case, a surface tension of the ink is preferably 20 dyn/cm or more (25° C.). If the temporary ink reservoir member has a smaller critical surface tension than a surface tension of the ink, a wetting property of the ink to the member becomes insufficient, and the ink hardly flows into comb teeth of the temporary ink reservoir, so that the function as a temporary ink reservoir can not sufficiently be exihited. Further, if a surface tension of the ink is less than 20 dyn/cm, the ink flowed into the temporary ink reservoir can not be held and is liable to flow directly into the pen tip, and the ink reservoir function is damaged. As a result, the excess ink is fed to the pen tip and causes troubles leading to ink leakage and blobbing.

A solubility parameter (25° C.) of the materials constituting a member and an ink is defined by $\delta=(\Delta E_v/V)^{1/2}$. $\Delta E^v$ is molar evaporation (aggregation) energy, and V is molar volume. They can be calculated.

Further, a solubility parameter can be obtained as well from a molar gravitation constant determined by Small method. That is, a molar gravitation constant ΔF and a molar volume ΔV of each atomic group are calculated from the molecular structure. The solubility parameter δ(25° C.) is defined by the following equation:

$$\delta=\Sigma\Delta F/\Sigma\Delta V, \text{ provided that } \Sigma\Delta F=(\Delta E^v\cdot V)^{1/2}$$

Small and Okitsu's values are used for ΔF values of respective atomic groups [reference: P. A. Small, J. Appl. Chem., 3, 71 (1953), R. F. Fedors, Polymer Eng. Sci., 14, 2, 147 (1974) and T. Okitsu, Adhesive, 38, 6, 6 (1974)].

A critical surface tension shows a wettability of a solid. Zisman et al [H. W. Fox, W. A. Zisman, J. Coloid Sci., 7, 109, 428 (1952)] measured contact angles of various liquids on a solid surface to find that almost linear relation resides between cos θ and a surface tension $\gamma_L$ ($=\gamma_{23}$) of a liquid, and the critical surface tension is represented by a surface tension $\gamma_c$ (dyne·cm$^{-1}$) obtained when this straight line is extrapolated to cos θ→1 (that is, θ→0°). This solid surface is wetted by a liquid having a smaller surface tension than $\gamma_c$, and therefore the larger $\gamma_c$ the solid has, the more liquids the solid is liable to get wet with.

Accordingly, in the present invention, a material constituting the temporary ink reservoir member and a solvent for the ink are so selected that a surface tension $\gamma_L$ of the ink is at least smaller than a critical surface tension $\gamma_c$ of the temporary ink reservoir member, and that an absolute value of a difference between values of solubility parameters of the material for the temporary ink reservoir member and the solvent contained in the ink is 1 or more, whereby it becomes possible to obtain the free ink type writing instrument in which the temporary ink reservoir member does not cause notable deformation and swelling with the solvent contained in the ink and the ink flows well into comb teeth of the temporary ink reservoir member.

EXAMPLES

The present invention shall further be explained below with reference to the specific examples of the present invention and comparative examples, but the present invention shall not be restricted only to these examples.

A critical surface tension $\gamma_c$ of the temporary ink reservoir member (solid) was determined based on Zisman method and measured at 25° C. by means of a measuring device Model CA-X manufactured by Kyowa Interface Science Co., Ltd.

A surface tension $\gamma_L$ of the ink was measured at 25° C. by means of a measuring device Model CBVP-A3 (Wilhelmy-type) manufactured by Kyowa Interface Science Co., Ltd.

Further, solubility parameters $\delta_P$, $\delta_S$ (25° C.) of the temporary ink reservoir member and the ink solvent were obtained by determining the solubility parameters by the molar gravitation constants based on Small method. In this case, Small and Okitsu's values were used for the Δ F values of the respective atomic groups [P. A. Small, J. Appl. Chem., 3, 71 (1953) and T. Okitsu, Adhesive, 38, 6, 6 (1974)].

Examples 1 to 6 and Comparative Examples 1 to 4

Materials of such cross-sectional comb teeth-shaped ink reservoir members as shown in FIG. 1 and inks are shown altogether in Table 1 and Table 2, wherein all the requisites of the present invention were satisfied in Examples 1 to 6, and a part of the requisites of the present invention was not satisfied in Comparative Examples 1 to 4. The following evaluation tests 1 to 3 were carried out for these respective requisites.

TABLE 1

| | Temporary ink reservoir member | | | Ink | | |
|---|---|---|---|---|---|---|
| Example | Material | $\gamma_c$ (dyn/cm) | $\delta_P$ | Kind of solvent | $\gamma_L$ (dyn/cm) | $\delta_s$ of solvent |
| 1 | PP (crystalline) | 29 | 7.3 | PGM | 24.5 | 11.5 |
| | $\lvert\delta_P - \delta_s\rvert = 3.6 > 1$, $\gamma_c = \gamma_L = 4.5 > 0$ | | | | | |
| 2 | PP (crystalline) | 29 | 7.9 | Ethanol | 22.1 | 12.7 |
| | $\lvert\delta_P - \delta_s\rvert = 4.8 > 1$, $\gamma_c = \gamma_L = 6.9 > 0$ | | | | | |
| 3 | PET (crystalline) | 43 | 13.8 | PGM | 24.1 | 11.5 |
| | $\lvert\delta_P - \delta_s\rvert = 2.3 > 1$, $\gamma_c = \gamma_L = 18.9 > 0$ | | | | | |
| 4 | POM (crystalline) | 40 | 10.7 | Ethanol | 22.1 | 12.7 |
| | $\lvert\delta_P - \delta_s\rvert = 2.0 > 1$, $\gamma_c = \gamma_L = 17.9 > 0$ | | | | | |
| 5 | POM (crystalline) | 40 | 10.7 | * | 30 | 12.1 |
| | $\lvert\delta_P - \delta_s\rvert = 1.4 > 1$, $\gamma_c = \gamma_L = 10 > 0$ | | | | | |

TABLE 1-continued

| Example | Temporary ink reservoir member: Material | $\gamma_c$ (dyn/cm) | $\delta_P$ | Ink: Kind of solvent | $\gamma_L$ (dyn/cm) | $\delta_s$ of solvent |
|---|---|---|---|---|---|---|
| 6 | PET (crystalline) | 43 | 13.8 | Ethanol | 22.1 | 12.7 |
| | $\lvert\delta_P - \delta_s\rvert = 1.1 > 1$, $\gamma_c = \gamma_L = 20.9 > 0$ | | | | | |

*: PGM/ethylene glycol = 0.80/0.2 molar fraction

TABLE 2

| Comparative Example | Temporary ink reservoir member: Material | $\gamma_c$ (dyn/cm) | $\delta_P$ | Ink: Kind of solvent | $\gamma_L$ (dyn/cm) | $\delta_s$ of solvent |
|---|---|---|---|---|---|---|
| 1 | Nylon 6 (crystalline) | 42 | 13.5 | Ethanol | 22.1 | 12.7 |
| | $\lvert\delta_p - \delta_s\rvert = 0.8 < 1$, $\gamma_c - \gamma_L = 19.9 > 0$ | | | | | |
| 2 | PP (crystalline) | 29 | 7.9 | Benzyl alcohol | 39.7 | 12.8 |
| | $\lvert\delta_p - \delta_s\rvert = 4.9 < 1$, $\gamma_c - \gamma_L = -10.7 > 0$ | | | | | |
| 3 | PS (non-crystalline) | 33 | 9.1 | Xylene | 30.0 | 8.8 |
| | $\lvert\delta_p - \delta_s\rvert = 0.3 < 1$, $\gamma_c - \gamma_L = -3.0 > 0$ | | | | | |
| 4 | PP (crystalline) | 29 | 7.9 | Water | 18 | 23.4 |
| | $\lvert\delta_p - \delta_s\rvert = 15.5 > 1$, $\gamma_c - \gamma_L = 11 > 0$ | | | | | |

Evaluation test (1)

Figure 2:
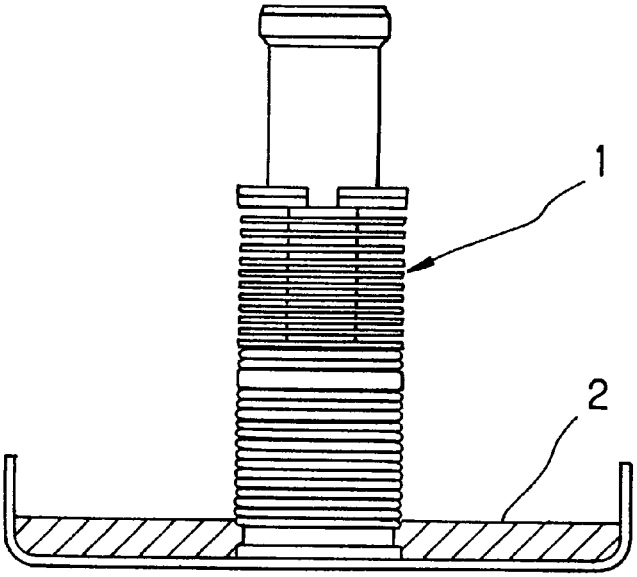
FIG. 2 is a situation explanatory drawing of Test 1 for determining sucking time of an ink.

As shown in FIG. 2, one end part of the temporary ink reservoir member 1 was dipped in the ink 2 to determine time required until the ink was sucked up to the seventeenth comb tooth from the bottom in every example and comparative example. The results thereof are summarized in Table 3.

It can be found from the results obtained in this evaluation test 1 that sucking of the ink is inferior in Comparative Example 2 in which a critical surface tension $\gamma_c$ of the temporary ink reservoir member is smaller than a surface tension $\gamma_L$ of the ink.

Evaluation test (2)

Figure 3:
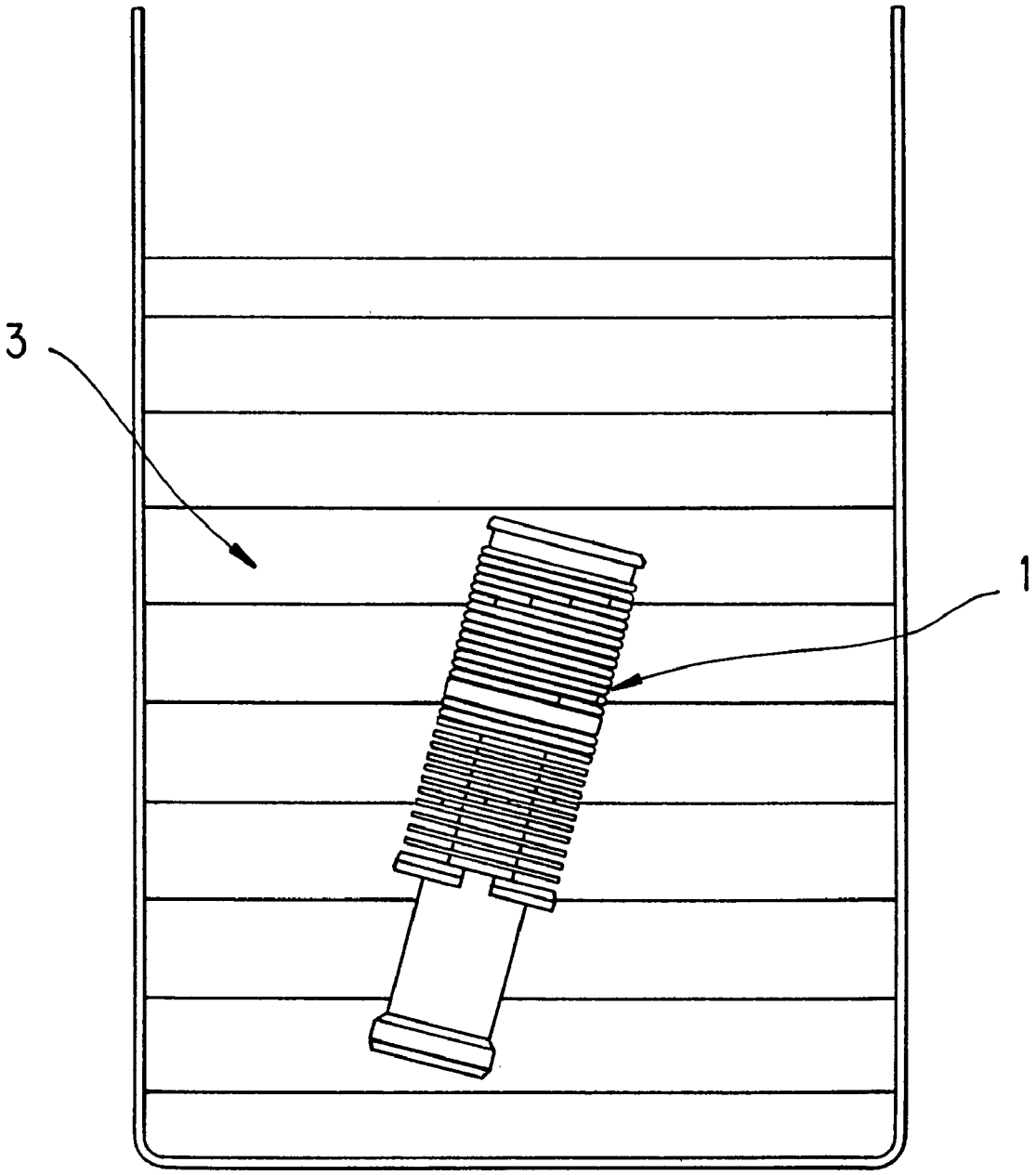
FIG. 3 is a situation explanatory drawing of Test 2 in which a temporary ink reservoir member is dipped in a solvent.

As shown in FIG. 3, the temporary ink reservoir member was immersed in the solvent 3 at 50° C. for 2 months to determine and observe a change in the dimension and appearance before and after immersion. The results thereof are summarized in Table 3. The dimensional change was shown by an average value obtained from independently measured five pieces of the member. The appearance change was evaluated according to the following criteria:

○: no change

Δ: swelling accompanied with no deformation and whitening

X: swelling accompanied with deformation, deformation, crack and dissolution

It can be found from the results obtained in this evaluation test 2 that the appearance change is notable in Comparative Example 1 in which an absolute value of a difference between values of the solubility parameters is 1 or less and in Comparative Example 3 in which an absolute value of a difference between values of the solubility parameters is 1 or less and PS of a non-crystalline polymer is used.

Evaluation test (3)

Figure 4:
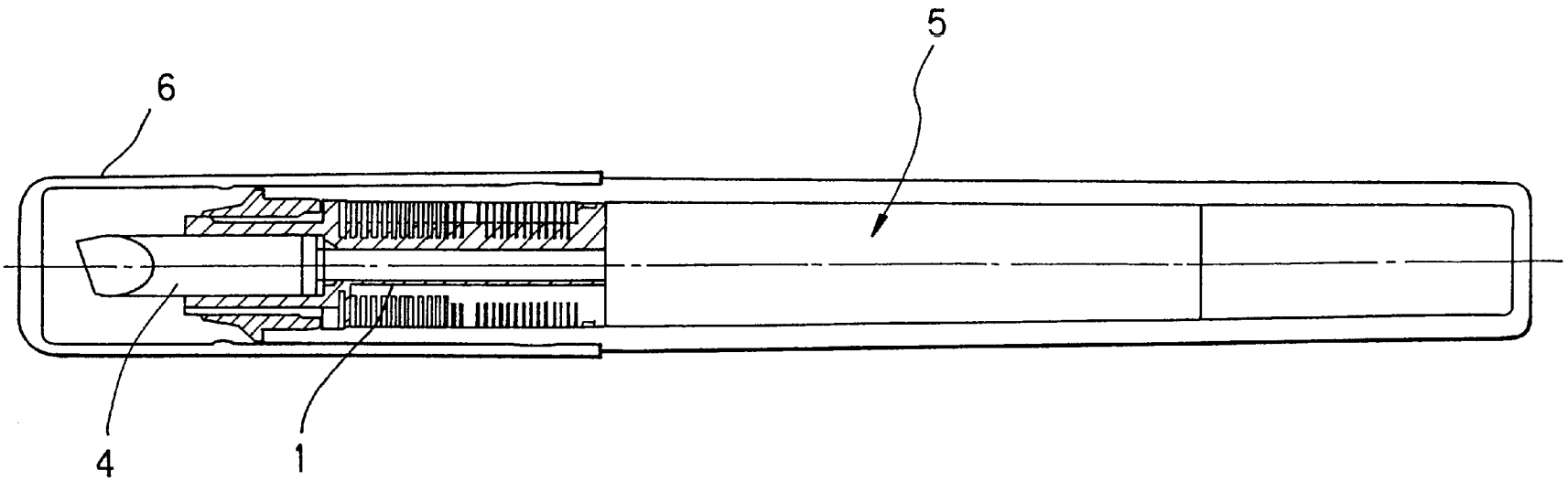
FIG. 4 is a longitudinal section of a free ink type writing instrument in which an ink reservoir member is assembled.

As shown in FIG. 4, the temporary ink reservoir member into which the pen tip 4 was installed was mounted in the tip of the free ink type writing instrument 5 containing the ink. Further, the cap 6 was fitted to prepare a pen instrument. It was stored at 50° C. for 24 hours, and immediately after finishing storing, the cap was removed to observe a flow condition of the ink into the temporary ink reservoir member. The observation results thereof are summarized in Table 3.

It can be found from the results obtained in this evaluation test 3 that the good results are obtained in all of Examples 1 to 6 in which the requisites of the present invention are satisfied, but the ink flow condition is deteriorated in all of Comparative Examples 1 to 4 in which a part of the requisites of the present invention is not satisfied.

TABLE 3

| | | Evaluation test 1: Sucking time (second) | 2: Dimensional change | 2: Appearance change | 3: Ink flow condition |
|---|---|---|---|---|---|
| Example | 1 | 24.0 | 0.8% | ○ | Good |
| | 2 | 13.3 | 0.3% | ○ | Good |
| | 3 | 12.5 | 1.8% | ○~Δ | Good |
| | 4 | 11.7 | 1.0% | ○ | Good |
| | 5 | 12.2 | 1.5% | ○~Δ | Good |
| | 6 | 10.1 | 1.9% | ○~Δ | Good |
| Comparative Example | 1 | 10.2 | Immeasurable | X | *1 |
| | 2 | >60 (up to fifth) | 0.8% | ○ | *2 |
| | 3 | 13.0 | Immeasurable | Δ~X | *3 |
| | 4 | 12.7 | 0.0% | ○ | *4 |

*1: Impossible to evaluate due to deformation of temporary ink reservoir member

*2: Ink flowed directly from pen tip before ink was stored in temporary ink reservoir member

*3: Temporary ink reservoir member was whitened and cracked and lost function

*4: Ink flowed directly from pen tip, and evaluation was impossible

What is claimed is:

1. A free ink type writing instrument using an ink containing an organic solvent as a main solvent, wherein a temporary ink reservoir member has a larger critical surface tension than a surface tension of the ink, and an absolute value of a difference between values of solubility parameters of a material constituting the temporary ink reservoir member and a solvent contained in the ink is 1 or more.

2. The writing instrument as described in claim 1, wherein the material constituting the temporary ink reservoir member comprises a crystalline polymer.

3. The writing instrument as described in claim 1, wherein the ink has a surface tension of 20 dyn/cm or more.

* * * * *